United States Patent [19]

Bridger et al.

[11] 4,060,491

[45] Nov. 29, 1977

[54] LUBRICANT COMPOSITION

[75] Inventors: Robert F. Bridger; Kirk D. Schmitt, both of Hopewell, N.J.

[73] Assignee: Mobil Oil Corporation, New York, N.Y.

[21] Appl. No.: 690,219

[22] Filed: May 26, 1976

Related U.S. Application Data

[63] Continuation-in-part of Ser. No. 619,098, Oct. 2, 1975, abandoned.

[51] Int. Cl.[2] ..... C10M 1/32; C10M 3/26; C10M 5/20; C10M 7/30

[52] U.S. Cl. ..... 252/50

[58] Field of Search ..... 252/50

[56] References Cited

U.S. PATENT DOCUMENTS

| | | | |
|---|---|---|---|
| 3,413,227 | 11/1968 | Howard et al. | 252/50 |
| 3,531,414 | 9/1970 | Randell et al. | 252/50 |
| 3,923,672 | 12/1975 | Durr et al. | 252/50 |

*Primary Examiner*—Delbert E. Gantz
*Assistant Examiner*—Irving Vaughn
*Attorney, Agent, or Firm*—Charles A. Huggett; Howard M. Flournoy

[57] ABSTRACT

A method is provided for reducing wear between moving steel-on-steel surfaces which comprises introducing between the surfaces a lubricant composition containing an antiwear amount of a 5-alkylbenzotriazole wherein the alkyl group contains from 4 to about 16 carbon atoms.

11 Claims, No Drawings

LUBRICANT COMPOSITION

CROSS-REFERENCE TO RELATED APPLICATIONS

This application is a continuation-in-part of Ser. No. 619,098, filed Oct. 2, 1975 and now abandoned.

BACKGROUND OF THE INVENTION

1. Field of the Invention

This invention relates to lubricant compositions and, in one of its aspects, relates more particularly to lubricant compositions intended for use as lubricants between steel-on-steel moving surfaces. Still more particularly, in this aspect, the invention relates to a method for reducing wear between moving steel-on-steel surfaces in which the lubricant composition contains an effective antiwear additive.

2. Description of the Prior Art

Prior to the present invention 5-n-butylbenzotriazole has been suggested as a metal deactivator in combination with dibutyl para cresol in insulating oils (Netherlands application No. 6,800,481, July 17, 1968) or as a corrosion inhibitor in lubricants, hydraulic fluids and mineral oil compositions (Netherlands application No. 6,414,144, June 8, 1965).

SUMMARY OF THE INVENTION

In accordance with the present invention, we have now found that wear between moving steel-on-steel surfaces can be reduced by introducing, between the surfaces, a lubricant composition containing an antiwear amount of 5-alkylbenzotriazole in which the alkyl group is either straight chain or branched and contains from 4 to about 16 carbon atoms. In this respect, it is essential that the alkyl group of the 5-alkylbenzotriazole contain not less than 4, and preferably no more than about 16 carbon atoms. If the alkyl group contains less than 4 carbon atoms, the 5-alkylbenzotriazole exhibits undesirable low solubility properties in the lubricant composition. On the other hand, if the 5-alkylbenzotriazole contains more than about 16 carbon atoms, the lubricant has a tendency to exhibit undesirably low antiwear properties. Preferably the alkyl group should therefore contain from 4 to about 12 carbon atoms. In another embodiment, the alkyl group contains from 4 to 8 carbon atoms. It is also essential that the 5-alkylbenzotriazole be employed in the lubrication of moving steel-on-steel surfaces. As hereinafter disclosed, the use of lubricants containing 5-alkylbenzotriazoles on steel-on-bronze surfaces results in increased wear of the metal surfaces to be lubricated therewith.

In general, the 5-alkylbenzotriazole, including specifically, 5-butylbenzotriazole, 5-pentylbenzotriazole, 5-hexylbenzotriazole, 5-heptylbenzotriazole, 5-octylbenzotriazole and 5-dodecylbenzotriazole may be present in the lubricant in any amount sufficient to impart the desired degree of antiwear properties. For many applications, the 5-alkylbenzotriazole may be present in an amount from about 0.001% to about 10% and preferably from about 0.1% to about 1% by weight. The 5-alkylbenzotriazole may be employed in any lubricant effective for lubricating moving steel-on-steel surfaces and can therefore be employed in oils of lubrication viscosity, mineral oils, synthetic lubricants, e.g. synthetic hydrocarbons, esters and mixtures thereof, and greases.

The synthesis of 5-alkylbenzotriazole can be carried out in the manner disclosed in the aforementioned Netherlands application No. 6,414,144, June 8, 1965. For example, an alkyl-4-aniline is reacted with appropriate amounts of $Ac_2O$ to yield the corresponding 4-alkylacetanilide which is then nitrated in the presence of additional $Ac_2O$ yielding 4-alkyl-2-nitroacetanilide. The nitroacetanilide is dissolved in a mixture of ethyl alcohol, potassium hydroxide and water, heated at reflux and cooled with the addition of sufficient amounts of water, saturated sodium chloride and $Et_2O$ to give 4-alkyl-2-nitroaniline. The reaction is then carried forward in appropriate manner to yield first 2-amino-4-alkylaniline and finally the desired product 5-alkylbenzotriazole.

DESCRIPTION OF THE SPECIFIC EMBODIMENTS

The following examples and comparative data will serve to illustrate more specifically the method of preparing the 5-alkylbenzotriazoles of this invention and the marked degree in antiwear improvement of moving steel-on-steel surfaces employing the 5-alkylbenzotriazoles of the present invention, as contrasted with the increased wear exhibited when the 5-alkylbenzotriazole is applied to moving steel-on-bronze surfaces.

THE EXAMPLES

EXAMPLE 1

Synthesis of 5-n-butylbenzotriazole

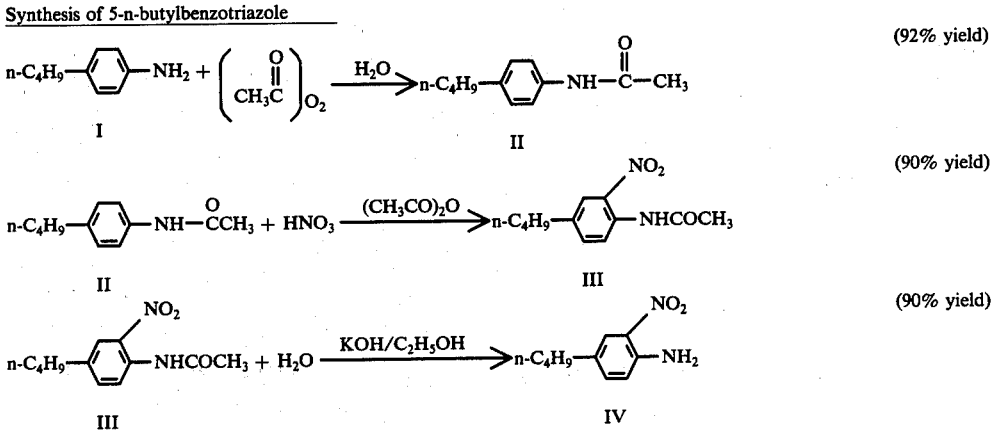

EXAMPLE 1-continued

Synthesis of 5-n-butylbenzotriazole

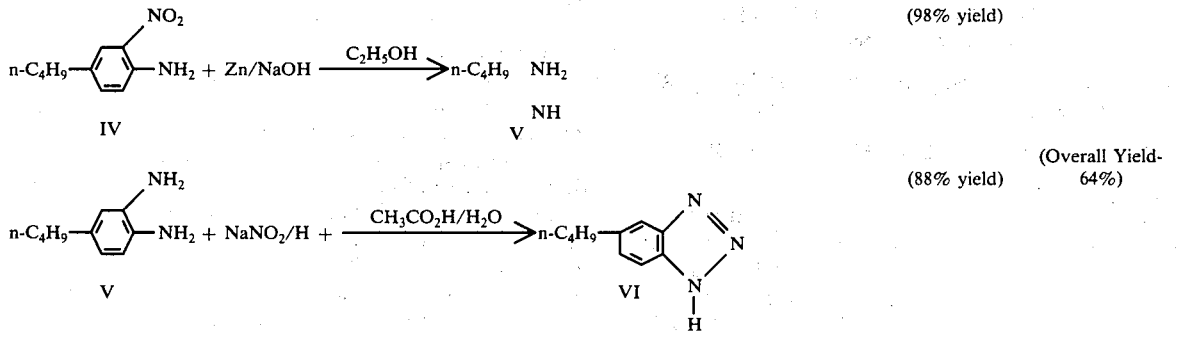

One hundred grams of I, 4-n-butylaniline, were stirred with 500 grams $H_2O$ and 410 grams acetic anhydride added all at once. The temperature rose spontaneously to 45° C. and was raised briefly to 85° C, to bring all the solids into solution. Slow cooling, filtration, and overnight air drying gave 117.4 grams (92%) white plates of II, 4-butylacetanilide, mp 104°-105° C. (lit.[1], mp 107° C). This 117.4 grams II were stirred with 486 grams acetic anhydride and 284 ml. 71% $HNO_3$ added at such a rate that, after a brief induction period and with ice cooling, the temperature was kept at 30°-35° C. The reaction mixture was stirred 30 minutes at 5° C, then 300 grams ice, followed by 600 ml. $H_2O$ were added and the yellow solid filtered, washed copiously with $H_2O$, and air dried to give 129.9 grams (90%) bright yellow III, 4-butyl-2-nitroacetanilide, mp 71°-73° C (lit.[1], mp 76° C).

This 129 of III were dissolved in 330 ml. 95% ethyl alcohol, a solution of 39.4 grams KOH in 60 ml. $H_2O$ added, the mixture heated at reflux 30 minutes, cooled, 400 ml. $H_2O$, 350 ml. saturated aqueous NaCl and 400 ml. diethyl ether added. The diethyl ether layer was separated, washed once with saturated aqueous NaCl, dried over $MgSO_4$, filtered and distilled to give 96.3 grams (90%) bright orange-red IV, 4-butyl-2-nitroaniline, bp 138°-150° C/0.5-0.8 mm. (lit.[1], bp 138° C/0.6 mm).

[1]Neth. Appl. 6,414,144; C.A., 63, 181303h (1965).

This 96.3 g of IV were dissolved in 200 ml. 95% ethyl alcohol, 39.7 ml. 20% aqueous NaOH added and the mixture heated at gentle reflux. Heating was discontinued and 130 grams zinc dust added in small portions at a rate to maintain reflux. After 30 minutes additional reflux, the mixture was filtered hot, the solid washed with 300 ml. hot ethyl alcohol and the combined ethyl alcohol solutions reduced in vacuo to about 150 ml. The residue was extracted with two 150 ml. portions of diethyl ether with in turn were washed once with 100 ml. $H_2O$ and once with 100 ml. saturated aqueous NaCl, dried over $MgSO_4$, filtered and the diethyl ether removed in vacuo to give 79.8 grams (98%) purple crystals of V, 2-amino-4-butylaniline, whose structure follows from its mode of synthesis and $^1H$ NMR spectrum:

| Chemical Shift[2] | Description[3] | Integral | Assignment |
|---|---|---|---|
| 6.5 ppm | 2s | 2.8H | Aromatic Hydrogens |
| 3.3 | s | 4.0 | $NH_2$, $NH_2$ |
| 2.4 | t | 2.0 | $-CH_2Ph$ |

-continued

| Chemical Shift[2] | Description[3] | Integral | Assignment |
|---|---|---|---|
| 0.8 - 1.8 | m and t | 7.1 | $CH_3CH_2CH_2-$ |

[2]Relative to internal tetramethylsilane.
[3]s = singlet, t = triplet, m = multiplet.

The 79.8 g of V were stirred with 58.9 grams acetic acid and a solution of 36.5 grams $NaNO_2$ in 150 ml. $H_2O$ added all at once. The temperature rose spontaneously to 80° C. After cooling slowly to room temperature 200 ml. diethyl ether, 100 ml. 7% aqueous $NaHCO_3$ and enough solid $NaHCO_3$ were added to give a pH $\approx$ 6. The diethyl ether layer was separated, washed with 100 ml. 7% aqueous $NaHCO_3$, once with 100 ml. saturated aqueous NaCl, dried over $MgSO_4$, filtered and distilled to give 74.9 grams (88%) pale brown VI, 5-n-butylbenzotriazole, bp 188° C/0.8 mm, mp 59.5°-62° C (lit.[1], bp 210°-C/0.1 mm, mp 65° C).

EXAMPLE 2

5-n-Octylbenzotriazole was prepared according to the procedure of Example 1, except that the starting material for the synthesis was 4-n-octylaniline.

EXAMPLE 3

5-Dodecylbenzotriazole was prepared according to the procedure of Example 1, except that the starting material for the synthesis was 4-dodecylaniline in which the dodecyl group was derived from propylene tetramer.

In the manner described above for the synthesis of 5-n-butylbenzotriazole, starting with 4-n-butylaniline, 5-pentylbenzotriazole, or 5-hexylbenzotriazole, or 5-heptylbenzotriazole, etc. can also be synthesized starting with 4-pentylaniline, 4-hexylaniline, 4-heptylaniline, etc.

In the antiwear test data reported hereinbelow in Tables I and II the base stock lubricant comprises a 150 SSU at 210° F refined paraffinic bright stock lubricating oil. The steel-on-steel data obtained were in accordance with the standard Four-Ball Wear test. This test is disclosed in U.S. Pat. No. 3,423,316. In general, in this test three steel balls of SAE 52-100 steel are held in a ball cup. A fourth steel ball positioned on a rotatable vertical axis is brought into contact with the three balls and is rotated against them. The force with which the fourth ball is held against the three stationary balls may be varied according to a desired load. The test lubricant is added to the ball cup and acts as a lubricant for the rotation. At the end of the test, the steel balls are investigated for wear-scar; the extent of scarring represents the effectiveness of the lubricant as an antiwear agent. Results are also reported as wear rates in volume of wear per unit sliding distance per kilogram load. The lower the wear rate, the more effective the lubricant as an antiwear agent. In the steel-on-bronze test, the three stationary balls have been replaced by bronze specimens.

The aforementioned Table I below shows the marked decrease in coefficient of friction, wear-scar diameter and wear rate, obtained with respect to moving steel-on-steel surfaces employing the above-described Four-Ball Wear Test.

Table I

Four Ball Wear Test Results on Substituted Benzotriazoles

Steel-on-Steel, 40 Kg load, 30 Minutes, 600 rpm, 400° F

| Additive in Mineral Oil Base Stock | Conc, Wt. % | Conc, mol/Kg | Coefficient of Friction | Wear Scar Diameter, mm | Wear Rate $\times 10^{12}$ cc/cm-Kg |
|---|---|---|---|---|---|
| None (Base stock lubricant) | — | — | 0.1593 | 0.8341 | 10.5 |
| Benzotriazole | 0.1 | 0.0084 | 0.1183 | 0.7074 | 5.25 |
| Tolytriazole | 0.1 | 0.0075 | 0.1267 | 0.7620 | 7.18 |
| Example 1, 5-n-Butylbenzotriazole | 0.1 | 0.0057 | 0.0996 | 0.4615 | 0.749 |
| Example 2, 5-n-Octylbenzotriazole | 0.1 | 0.0043 | 0.0853 | 0.4934 | 1.045 |
| Example 3, 5-Dodecylbenzotriazole | 0.1 | 0.0035 | 0.1065 | 0.7112 | 5.37 |
| Example 3, 5-Dodecylbenzotriazole | 0.2 | 0.0070 | 0.0966 | 0.4394 | 0.580 |

Table II

Four Ball Wear Test Results on Substituted Benzotriazoles

Steel-on-Bronze, 40 Kg load, 20 minutes, 175° F

| Additive in Mineral Oil Base Stock | Conc, Wt. % | Coefficient of Friction | Wear Scar Diameter, mm | Wear Rate $\times 10^{12}$ cc/cm-Kg |
|---|---|---|---|---|
| | | 600 RPM | | |
| None (Base stock) lubricant) | — | 0.0607 | 0.820 | 6.58 |
| 5-n-butylbenzotriazole | 0.1 | 0.070 | 0.889 | 9.40 |
| | | 3000 RPM | | |
| None (Base stock lubricant) | — | 0.055 | 1.04 | 3.70 |
| 5-n-butylbenzotriazole | 0.1 | 0.190 | 2.04 | 57.6 |
| 5-n-octylbenzotriazole | 0.1 | 0.221 | 2.29 | 93.2 |

Table III

Solubilities of Benzotriazoles in Bright Stock

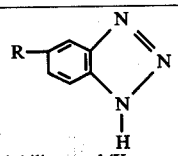

| R | Solubility, mol/Kg | Solubility, wt. % |
|---|---|---|
| H | 0.005 | 0.060 |
| $CH_3$ | 0.01 | 0.133 |
| $C_4H_9$ | 0.025 | 0.438 |
| $C_{12}H_{25}$ | >>0.08 | >>2.3 |

Table II shows the marked increase in coefficient of friction, wear scar diameter and wear rate obtained with respect to moving steel-on-bronze surfaces employing the above-described Four-Ball Wear Test. These tests were conducted at both 600 rpm and 3,000 rpm. as appears in the table.

As will be noted with respect to Table I, illustrating the improved steel-on-steel antiwear characteristics of this invention, the specific tests were carried out employing the following compounds embodied herein as the antiwear agent; 5-n-butylbenzotriazole, 5-n-octylbenzotriazole and 5-dodecylbenzotriazole; with respect to Table II illustrating the steel-on-bronze characteristics, 5-dodecylbenzotriazole and 5-n-octylbenzotriazole were utilized as the antiwear agent. Table III illustrates the relative solubilities of certain of the alkylbenzotriazoles disclosed herein in the base stock.

While the present invention has been described with reference to preferred compositions and components therefor, it will be understood by those skilled in the art that departure from the preferred embodiments can be effectively made and are within the scope of the specification.

We claim:

1. A method for reducing wear between moving steel-on-steel surfaces which comprises introducing between said surfaces a lubricant composition comprising an oil of lubricating viscosity or a grease prepared therefrom containing an antiwear amount of a 5-alkylbenzotriazole wherein the alkyl group contains from 4 to 16 carbon atoms.

2. The method of claim 1 wherein the 5-alkylbenzotriazole is present in an amount from about 0.001% to about 10%, by weight.

3. The method of claim 1 wherein the 5-alkylbenzotriazole is present in an amount from about 0.1% to about 1%, by weight.

4. The method of claim 1 wherein the lubricant composition comprises an oil of lubricating viscosity.

5. The method of claim 1 wherein the lubricant composition comprises a mineral oil.

6. The method of claim 1 wherein the lubricant composition comprises a grease.

7. The method of claim 1 wherein said alkyl group contains from 4 to about 12 carbon atoms.

8. The method of claim 1 wherein said alkyl group contains from 4 to 8 carbon atoms.

9. The method of claim 1 wherein the 5-alkylbenzotriazole is 5-n-butylbenzotriazole.

10. The method of claim 1 wherein the 5-alkylbenzotriazole is 5-n-octylbenzotriazole.

11. The method of claim 1 wherein the 5-alkylbenzotriazole is 5-dodecylbenzotriazole.

* * * * *